United States Patent [19]

Wambsgans

[11] Patent Number: 4,462,899

[45] Date of Patent: Jul. 31, 1984

[54] HYDROCYCLONE CLEANER ASSEMBLY

[75] Inventor: Robert O. Wambsgans, Springfield, Ohio

[73] Assignee: The Bauer Bros. Co., Springfield, Ohio

[21] Appl. No.: 451,116

[22] Filed: Dec. 20, 1982

[51] Int. Cl.[3] ..... B04C 5/28

[52] U.S. Cl. ..... 209/211; 209/144

[58] Field of Search ..... 209/144, 211; 210/512.2

[56] References Cited

U.S. PATENT DOCUMENTS

| | | | |
|---|---|---|---|
| 2,809,567 | 10/1957 | Woodruff | 209/211 |
| 3,543,931 | 12/1970 | Rastatter | 209/211 |
| 4,019,980 | 4/1977 | Beery | 209/211 |
| 4,148,721 | 4/1979 | Brown et al. | 209/211 |
| 4,163,719 | 8/1979 | Macierewicz et al. | 209/211 |
| 4,233,160 | 11/1980 | Macierewicz et al. | 209/211 |
| 4,260,480 | 5/1981 | Lewis et al. | 209/211 |

*Primary Examiner*—Tim R. Miles

*Attorney, Agent, or Firm*—William W. Habelt

[57] ABSTRACT

A centrifugal cleaner and assembly thereof for separating solids from a fluid suspension. Each cleaner has an accepts plenum chamber, a slurry inlet plenum chamber adjacent thereto, a rejects plenum chamber disposed in alignment with and spaced from the accepts and slurry inlet chambers, and an axially elongated tubular shell for defining a centrifugal separating chamber disposed between the accepts chamber and rejects chamber. A multiplicity of cleaners are nested in side-by-side alignment so that the slurry inlet chambers, the accepts chambers, and the rejects chambers are interconnected with their respective counterparts to form a longitudinally elongated accepts plenum, a longitudinally elongated slurry inlet plenum, and a longitudinally elongated rejects plenum which serve to provide fluid communication between each of the cleaners and the accepts collection tank, the slurry supply tank and the rejects collection tank.

2 Claims, 8 Drawing Figures

HYDROCYCLONE CLEANER ASSEMBLY

BACKGROUND OF THE INVENTION

The present invention relates to an improvement in centrifugal cleaners or separators and, more particularly, to a centrifugal cleaner and a centrifugal cleaner assembly which is uniquely compact and adaptable to a wide variety of applications.

Hydrocyclone cleaners, for example, of the type shown in U.S. Pat. No. 2,809,567, are used in many applications to separate and classify the contents of a slurry into an accepts stream and a rejects stream so that the accepts stream may be eventually utilized in a particular process and the rejects stream either further processed to recover acceptable material or disposed of. Such applications include food processing, chemical processing, metal working, mining and drilling, sewage and waste treatment, water pollution control, and pulp and papermaking. While the field of art relating to slurry separation and classification is based on concepts which are relatively simple and is at a highly-advanced state, many problems have been encountered in developing physical systems to carry out these basic concepts in an economical and efficient manner.

One particular problem has been in the physical clustering of a plurality of individual hydrocyclone cleaners into a compact cleaner assembly. Hydrocyclones may be disposed vertically, horizontally or even radially and still accomplish their function in an efficient manner. However, elaborate and sometimes complex piping and connecting ducts are necessary to interconnect the individual hydrocyclone cleaners of the assembly to the slurry supply, the accepts tank and the rejects tank associated with the cleaner assembly. For example, U.S. Pat. Nos. 4,019,980 and 4,148,721 show multiple hydrocyclone cleaners assembled in two prior art arrangements. A normal installation of such cleaners entails a substantial amount of plumbing and hardware and the availability of a considerable amount of space. Prior art hydrocyclone arrangements often do not lend themselves to easy installation, maintenance or observation of the cleaning operations. Therefore, there is a need to provide a hydrocyclone cleaner assembly in a compact form.

SUMMARY OF THE INVENTION

It is to the solution of the foregoing problem that the present invention is directed. Accordingly, it is a primary object of the present invention to provide an improved hydrocyclone cleaner which may be readily coupled to other hydrocyclone cleaners in a simple and economical manner to provide a cleaner assembly.

Another object of the present invention is to provide a uniquely compact hydrocyclone cleaner assembly which may be easily erected on site and is adapted to facilitate the removal of individual hydrocyclone cleaners therefrom for repair or maintenance in a simple and efficient manner.

In accordance with the present invention, a centrifugal cleaner is provided for separating solids from a fluid suspension or slurry comprising a first fluid plenum chamber, a second fluid plenum chamber adjacent thereto, a third fluid plenum chamber disposed in alignment with and spaced from the first and second fluid chambers, and an axially elongated tubular shell for defining a centrifugal separating chamber disposed therebetween. The elongated tubular shell has means defining a slurry inlet and means defining an axially directed accepts outlet at one end of the separating chamber and means defining an axially directed rejects outlet at the axially opposite end of the separating chamber. The inlet means opens directly into the second fluid plenum chamber and the accept outlet means opens directly into the first fluid plenum chamber. The rejects outlet opens directly into the third fluid chamber. Accordingly, the hydrocyclone cleaner of the present invention has integral accepts, rejects and slurry inlet chambers thereby eliminating a significant amount of piping.

Additionally, the present invention provides a centrifugal cleaner assembly comprising a multiplicity of centrifugal cleaners aligned in side-by-side relationship, each of the individual centrifugal cleaners having an accepts plenum chamber, a slurry inlet plenum chamber, a rejects plenum chamber disposed in alignment with and spaced from the accepts and slurry inlet plenum chambers, and an axially elongated tubular shell defining a separating chamber disposed therebetween. The centrifugal cleaners are aligned such that the accepts chamber of each cleaner is mated with and open in fluid communication with the accepts chamber of each centrifugal cleaner adjacent thereto. The slurry inlet chamber of each centrifugal cleaner is also mated with and open in fluid communication with the slurry inlet chamber of each centrifugal cleaner adjacent thereto. The rejects plenum chamber of each centrifugal cleaner is mated with and open in fluid communication with the rejects plenum chamber of each adjacent cleaner.

Therefore, the slurry inlet chambers, the accepts chambers, and the rejects chambers of the multiplicity of centrifugal cleaners are interconnected with their respective counterparts so as to form a longitudinally elongated accepts plenum chamber, a longitudinally elongated slurry inlet chamber and a longitudinally elongated rejects chamber spaced therefrom. Each of the centrifugal cleaners has a slurry inlet opening directly into the longitudinally elongated inlet slurry plenum chamber, an axially directed accepts outlet opening directly into the longitudinally elongated accepts plenum chamber, and an axially directed rejects outlet opening directly into the longitudinally elongated rejects chamber.

BRIEF DESCRIPTION OF THE DRAWINGS

The present invention may be better understood and the unique features and advantages of the invention made more evident by reference to the accompanying drawing wherein.

DESCRIPTION OF THE PREFERRED EMBODIMENT

Figure 1:
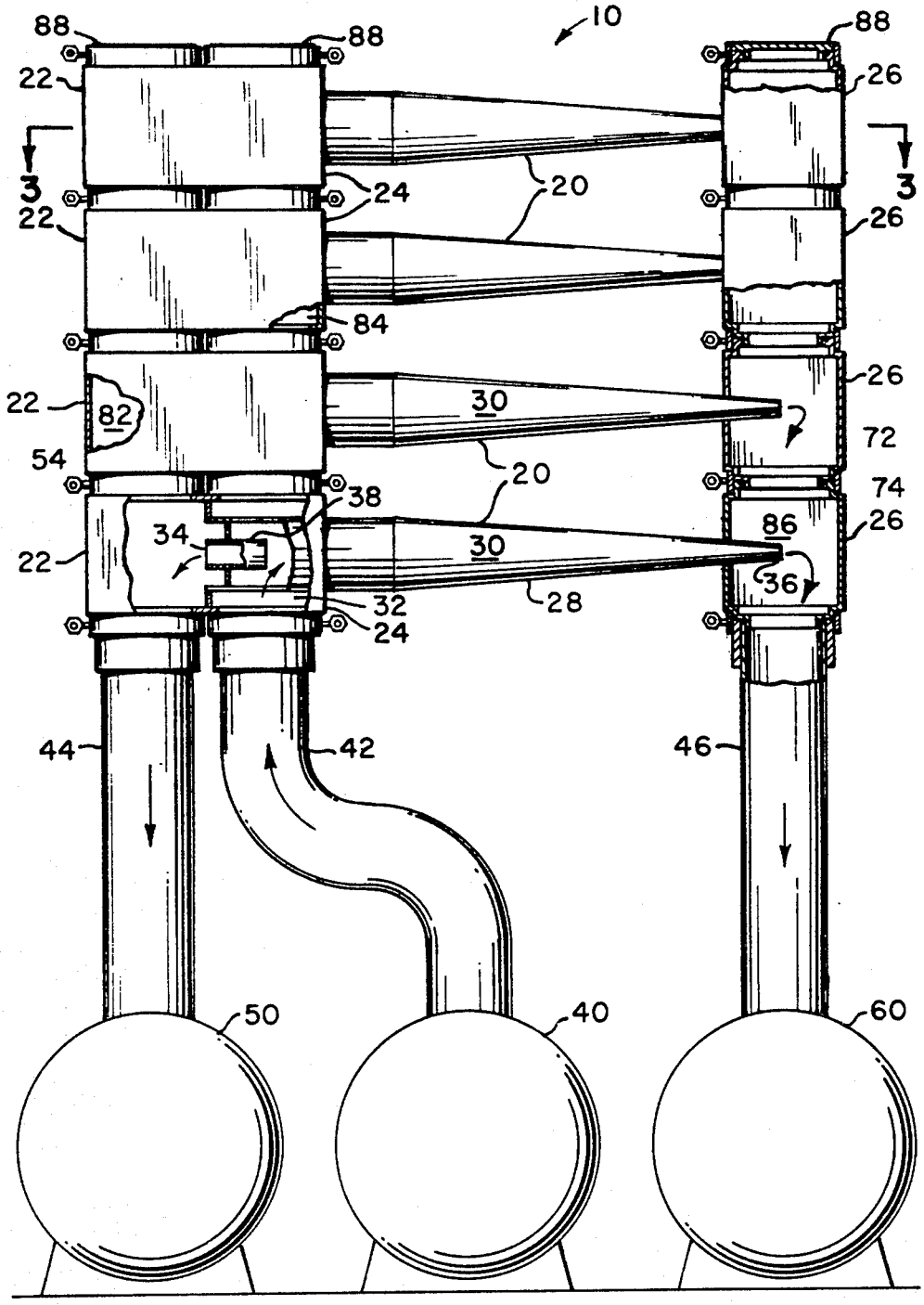
FIG. 1 is a side elevational view partly in section of one embodiment of a cleaner assembly comprised of a multiplicity of hydro-cyclone type cleaners aligned in side-by-side relationship in a vertical array in accordance with the present invention.

Referring now to the drawing, there is depicted two embodiments of a cleaner assembly 10 comprised of a multiplicity of independent centrifugal separators, commonly referred to as hydrocyclone cleaners, disposed in side-by-side alignment in a vertical array. It should be noted, however, that although the individual centrifugal cleaners are shown in the drawing in a preferred embodiment in the form of a stacked vertical array, it is to be understood that the cleaner assembly may also be formed of a multiplicity of individual centrifugal cleaners nested in a horizontal array or even orientated at an angle between horizontal and vertical.

Figure 3:
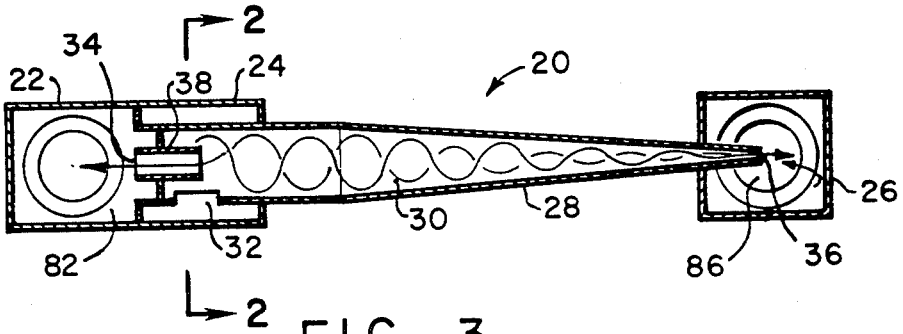
FIG. 3 is a sectional side elevational view of a single hydrocyclone cleaner of FIG. 1.
Figure 7:
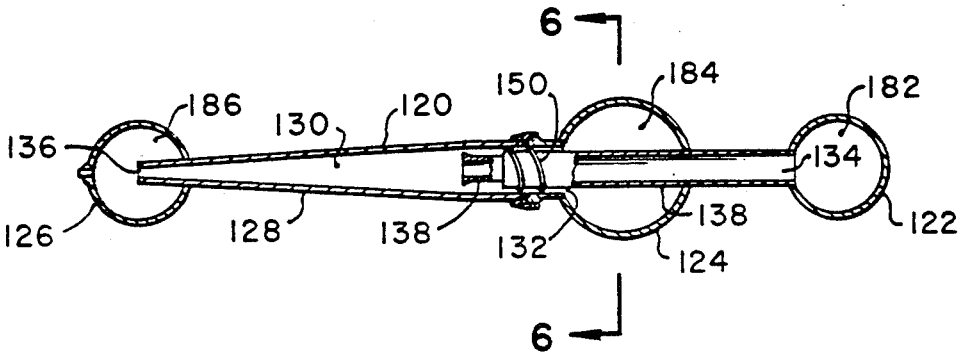
FIG. 7 is a sectional side elevational view of a single hydrocyclone cleaner of FIG. 5.

As best seen in FIGS. 3 and 7 respectively, each of the individual centrifugal cleaners 20, 120 comprises a first fluid plenum chamber 22, 122 which serves as an accepts plenum chamber, a second fluid plenum chamber 24, 124 which serves as a slurry inlet plenum chamber, and a third fluid plenum chamber 26, 126 disposed in alignment and spaced from the first and second fluid plenum chambers which serves as a rejects plenum chamber. An axially elongated tubular shell 28, 128 defining a centrifugal separating chamber 30, 130 is disposed between the accepts chamber and the rejects chamber. Each centrifugal separating chamber 30, 130 has an axially directed accepts outlet 34, 134 disposed at the inlet end of the tubular shell 28, 128 and an axially directed rejects outlet 36, 136 disposed at the axially opposite end of the elongated tubular shell. The axially directed accepts outlet 34, 134 opens directly into the accepts plenum chamber 22, 122 thereby providing flow communication for the flow of accepts directly from the separating chamber into the accepts plenum chamber. Similarly, the axially directed rejects outlet 36, 136 opens directly into the rejects plenum chamber 26, 126 thereby providing flow communication directly from the separating chamber through which the rejects stream flows directly into the rejects plenum chamber.

Each separating chamber 30, 130 includes a slurry inlet means 32, 132 opening directly into the slurry inlet plenum 24, 124 through which the slurry to be separated enters the separating chamber. In order for proper separation to occur within the separating chamber, a vortex flow must be generated within the separating chamber. This vortex is generated by causing the slurry or liquid suspension entering the chamber separating through inlet means 32, 132 to travel a helical path as it passes from the slurry inlet plenum through the inlet means into the separating chamber.

In the FIG. 1 embodiment, the liquid suspension is pumped under pressure from supply tank 40 through supply duct 42 to the inlet plenum 24 and then passes from the inlet plenum 24 to each of the individual hydrocyclone cleaners 20 through the tangential inlet 32 into the separating chamber 30. As the liquid suspension moves through the tangential inlet 32 it travels a helical path along the wall thereby generating a vortex within separating chamber 30. As the liquid suspension flows through the separating chamber 30 from the tangential inlet 32 to the axially directed outlet 36, it continues to travel a helical path along the wall of the elongated tubular shell 28.

Figure 5:
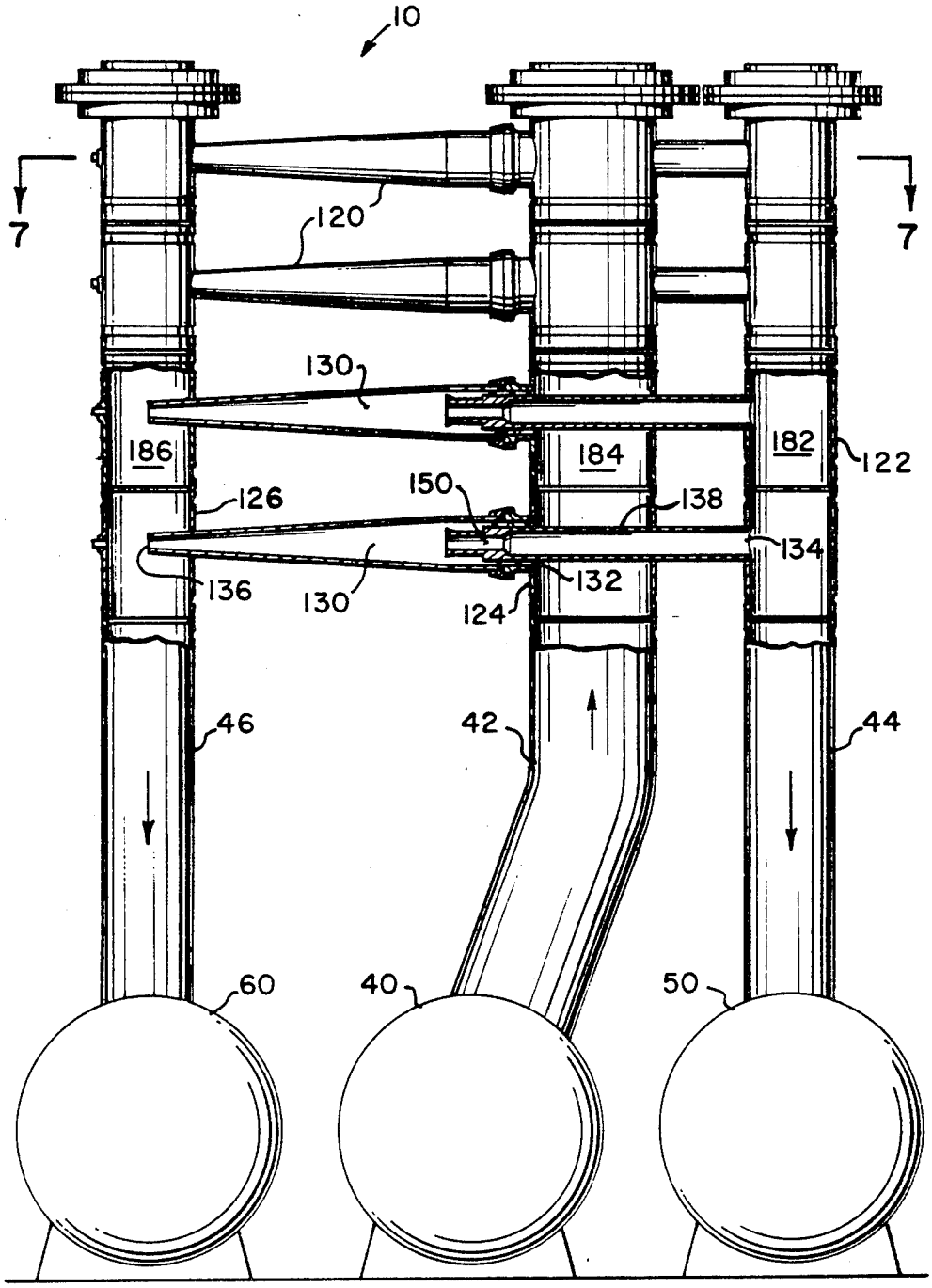
FIG. 5 is a side elevational view partly in section of an alternate embodiment of a cleaner assembly comprised of a multiplicity of hydrocyclone type cleaners aligned in side-by-side relationship in a vertical array in accordance with the present invention.

In the FIG. 5 embodiment of the hydrocyclone cleaner, the liquid suspension is pumped under pressure from the supply tank 40 through supply duct 42 to the inlet plenum 124 of each of the hydrocyclone cleaners and then passes from inlet plenum 124 axially through the annular inlet 132 into the separating chamber. As the liquid suspension passes through annular inlet 132, it traverses swirl means 150 disposed within the annular inlet 132 causing the incoming suspension or slurry to travel a helical path thereby generating a vortex within the separating chamber.

The forces generated in the vortex flow of the liquid suspension or slurry passing through the separating chamber 30, 130 from the inlet 32, 132 thereof to the outlet 36, 136 thereof induce a counterflow of material through the center of the vortex and out the axial outlet 34, 134 of the separating chamber. The relatively light particles in the liquid suspension flowing through the separating chamber are entrained in the counterflow and are conducted thereby out of the separating chamber into the accepts chamber 22, 122 by way of the tube 38, 138 defining the outlet 34, 134 of the separating chamber. From the accepts chamber, the accepts stream flows through conduit 44 to the accepts collection tank 50. Similarly, the rejects stream, that is the relatively heavy particles in the liquid suspension flowing through the separating chamber, flow out of the outlet 36, 136 into the rejects plenum chamber 26, 126 and thence through conduit 46 to the rejects collection tank 60.

Figure 2:
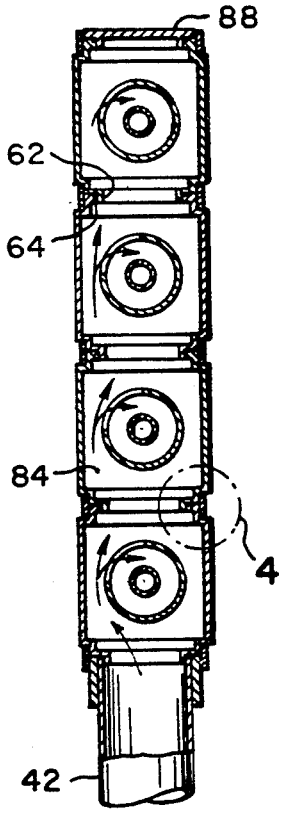
FIG. 2 is a cross-sectional view taken along lines 2—2 of FIG. 3.

In the embodiment of the cleaner assembly of the present invention shown in FIGS. 1 and 2, each of the plenum chambers 22, 24 and 26 of each of the centrifugal cleaners 20 is rectangular in cross-section, as shown in FIG. 3, and has aligned inlets and outlets. The cleaner assembly is formed by stacking the individual cleaners 20 in a vertical array with mated inlets and outlets. Each accepts chamber 22 has a flanged inlet 32 in one wall thereof and a flanged outlet 54 in the wall opposite thereto. Similarly, each slurry inlet plenum has a flanged inlet 62 in one wall thereof and a flanged outlet 64 in the wall opposite thereto. Further, each rejects plenum chamber 26 has a flanged inlet 72 in one wall thereof and a flanged outlet 74 in the wall opposite thereto.

The inlets and outlets of the plenum chambers 22, 24, and 26 of each of the individual cleaners 20 are adapted to nest with the outlets and inlets, respectively, of their neighboring centrifugal cleaners. That is, the inlet 52 of one centrifugal cleaner 30 is adapted to nest with the outlet 54 of the adjacent centrifugal cleaner when the cleaners are stacked in side-by-side relationship. Similarly, the inlet 62 to the slurry inlet plenum 24 of one centrifugal cleaner is adapted to nest with the outlet 64 of its adjacent centrifugal cleaner. Also, the inlet 72 to the rejects chamber 26 of one centrifugal cleaner is adapted to nest with the outlet 74 to the rejects chamber 26 of its adjacent centrifugal cleaner.

When disposed in side-by-side alignment either in a vertical array as shown in FIGS. 1 and 2 or in a horizontal array, the nesting of the inlets and outlets of the respective plenum chambers produces an accepts conduit 82 which interconnects in fluid communication all of the accepts plenum chambers 22 of the individual cleaners 20. A slurry conduit 84 is also formed which interconnects all the slurry inlet plenum 24 of the individual cleaners 20, and a rejects conduit 86 is also formed which interconnects all the rejects plenum chambers 26 of the individual cleaners 30. Each of the conduits 82, 84 and 86 formed by nesting the accepts chambers 22, the slurry inlet plenum chambers 24 and the rejects plenum chambers 26, respectively, together is terminated by an end cap 88 secured to the outlets of each of the plenum chambes 22, 24 and 26 of the uppermost cleaner 20.

By connecting the flange inlet 52 of the lowermost cleaner 20 with the accepts return conduit 44, fluid communication is established between each of the individual accepts plenum chamber 22 via conduit 82 and accepts return conduit 44 to the accepts collection tank 50. Similarly, by connecting the flanged inlet 62 of the slurry inlet plenum chamber 24 of the lowermost separator 30 to the slurry supply conduit 42, fluid communication is established between each of the individual slurry inlet plenum chambers 24 via conduits 84 and 42 with the slurry supply tank 40. By connecting the flange inlet 72 of the rejects chamber 26 of the lowermost cleaner 30 with rejects return conduit 46, fluid communication is established individual rejects plenum chambers 26 via conduits 86 and 46 with the rejects collection tank 60.

Figure 6:
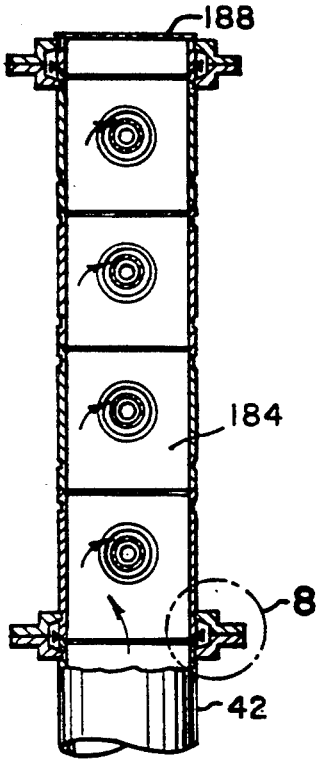
FIG. 6 is a cross-sectional view taken along lines 6—6 of FIG. 7.

In the embodiment of the cleaner assembly of the present invention shown in FIGS. 5 and 6, each of the plenum chambers 122, 124 and 126 of each centrifugal cleaners 120 is circular in cross-section, as shown in FIG. 7, and has aligned inlets and outlets. The cleaner assembly is formed by stacking the individual cleaners 120 in a vertical array with mated inlets and outlets.

Each plenum chamber 122, 124 and 126 has a tapered inlet thereto and a tapered outlet thereto. As best seen in FIG. 6, the inlets and outlets are tapered oppositely to each other so as to mate when the cleaners nest. For example, if the inlets have a male taper, the outlets will have a corresponding female taper thereby ensuring a tight fit upon mating when the cleaners are stacked.

When disposed in side-by-side alignment either in a vertical array as shown in FIGS. 5 and 6 or in a horizontal array, the nesting of the slurry inlet chamber inlets 162 with the slurry inlet chamber outlets 164 produces a slurry conduit 184 which interconnects all the slurry inlet plenums 124 of the individual cleaners 120. Similarly, an accepts conduit 182 is formed by nesting the inlets 152 and 154 of the accepts chambers 122 to interconnect all the accepts chambers of the individual cleaners, and a rejects conduit 186 is also formed by nesting the inlets 172 and outlets 174 of the rejects chambers 126 to interconnect all the accepts chambers of the individual cleaners. Each of the conduits 182, 184 and 186 formed by nesting the accepts chambers 122, the slurry inlet plenum chambers 124 and the rejects plenum chambers 126, respectively, together is terminated by an end cap 188 secured to the outlets of each of the plenum chambers 122, 124 and 126 of the uppermost cleaner 120.

By connecting the flange inlet 152 of the lowermost cleaner 120 with the accepts return conduit 44, fluid communication is established between each of the individual accepts plenum chambers 122 via conduit 182 and accepts return conduit 44 to the accepts collection tank 50. Similarly, by connecting the flanged inlet 162 of the slurry inlet plenum chamber 124 of the lowermost separator 120 to the slurry supply conduit 42, fluid communication is established between each of the individual slurry inlet plenum chambers 124 via conduits 184 and 42 with the slurry supply tank 40. By connecting the flange inlet 172 of the rejects chamber 126 of the lowermost cleaner 120 with rejects return conduit 46, fluid communication is established individual rejects plenum chambers 126 via conduits 186 and 46 with the rejects collection tank 60.

Figure 4:
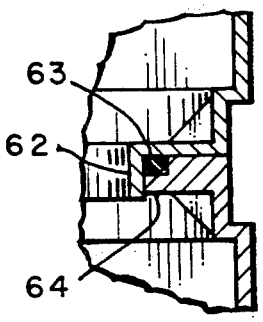
FIG. 4 is an enlarged view of section 4—4 of FIG. 2.

It is preferable to seal the nested interconnections between the inlets and outlets of adjacent cleaners in order to prevent fluid leakage therethrough. In the embodiment of FIGS. 1 and 2, the inlets and outlets are nested by providing for one to have an annular flange adapted to slide into and mate with a cylindrical flange of the other. For example, as best seen in FIG. 4 with respect to the mating of the slurry inlet plenum chambers, the outlet 64 of the slurry inlet plenum chamber has an annular flange which slides into a circumferential cylindrical flange on the inlet 62 of the chambers 24 so that the inlets and outlets are slidably engaged with the outlet 64 of one chamber within the inlet 62 of its neighboring counterpart when the cleaners 20 are nested. To seal this interface to fluid leakage, a ring seal 63 is placed between the flanged inlet 62 and the flanged outlet 64 when the cleaners are nested. A ring clamp is then placed around the outlet and the seal and tightened down to effectuate the seal between the flanged inlet and the flanged outlet and also to secure the flanged inlet within the flanged outlet.

Figure 8:
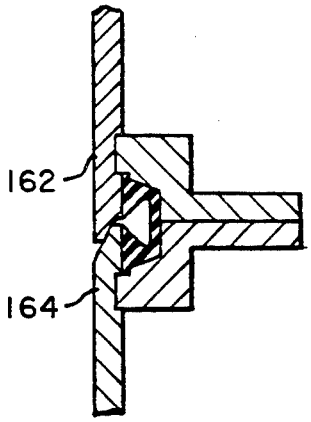
FIG. 8 is an enlarged view of section 8—8 of FIG. 6.

In the embodiment of FIGS. 5 and 6, the inlets and outlets are nested by providing a male tapered end face on one and a female tapered end face on the other. For example, as best seen in FIG. 8 with respect to the mating of the slurry inlet plenum chambers, the inlet 162 of the slurry inlet plenum chamber has a male, i.e., inward, tapered end face which slides into and mates with a female, i.e., outward, tapered end face on the outlet 164. Coupling means, preferably a Victaulic coupling, is installed in a conventional manner about the interface of the uppermost chambers with end caps 188 and about the interface of the lowermost chambers with the conduits 42, 44 and 46. Additionally, tie cables (not shown) may be strung between the uppermost and lowermost cleaners to help hold the cleaners therebetween in nested relationship. If desired, coupling means can also be placed between the tapered inlets and outlets of each set of neighboring cleaners to further secure the cleaners in nested relationship.

The simplicity in structure of the cleaner assembly of the present invention, as well as the simplicity of installing and dismantling the assembly, is believed self-evident from the foregoing description of the preferred embodiment. An extremely compact installation is provided with no hose connections necessary between the individual cleaners and the supply tanks. Rather, fluid communication can be established between a tank and each and every of the plenum chambers that tank serves by making a single connection between the supply conduit from that tank and the inlet to one of the many plenum chambers that tank may serve.

Maintenance of the cleaner assembly of the present invention is also greatly simplified by the arrangement of the present invention. If a cleaner becomes defective, it may be changed by draining the system, unfastening the ring clamps or couplings securing the defective cleaner, then separating the defective cleaner from its neighbors, and either replacing it with a new cleaner or merely reassembling the cleaner assembly. Therefore, all that is required to remove a cleaner for maintenance is the mere unfastening of some clamps or couplings, removing the defective cleaner and reassembling the clamps or couplings.

The present invention also provides a cleaner assembly which may be readily expanded or even contracted depending upon the needs of a particular installation. Additional cleaners can be added to the assembly simply by removing the end caps on the uppermost cleaner and stacking additional cleaners thereon.

Thus, the present invention provides a uniquely compact cleaner assembly which facilitates the erection of the assembly, the removal and interchange of cleaners, and the expansion of an installation. The cleaner assembly of the present invention affords economy of space, economy of labor, and economy of capital cost.

While the present invention has been described and illustrated herein in relation to two embodiments of a vertical array of individual cleaners, it is to be understood that the present invention may apply to any orientation of a cleaner array wherein the cleaners are nested together as described herein in side-by-side relationship. Further, it is to be understood that the specific embodiments shown in the drawing are merely illustrative of two modes for carrying out the invention and are by no means meant as a limitation. Accordingly, it is intended that any modification which is apparent to those skilled in the art in light of the foregoing description and which falls within the spirit and scope of the appended claims be included in the invention as recited in the appended claims.

I claim:

1. A centrifugal cleaner for separating solids from a fluid suspension comprising:

a. a first fluid plenum chamber;

b. a second fluid plenum chamber disposed adajcent said first fluid plenum chamber;

c. a third fluid plenum chamber disposed in alignment with and spaced from said first and second fluid plenum chambers; and d. an axially elongated tubular shell defining a centrifugal separating chamber having means defining an inlet and means defining an axially directed accepts outlet at one end of the separating chamber and means defining an axially directed rejects outlet at the axially opposite end of the separating chamber, the inlet means opening directly into said second fluid plenum chamber and the accepts outlet means opening directly into said first fluid plenum chamber and the rejects outlet means opening directly into said third fluid chamber, each of said first, second and third plenum chambers having a first fluid flow opening in a first wall thereof and a second fluid flow opening in a second wall thereof opposite the first wall thereby providing flow passages through which said fluid suspension may enter and leave said plenum chambers, each of said first and second fluid flow openings comprising flanged openings, the flange of the first fluid flow opening being an annular flange adapted to be slidably matable with a cylindrical flange of the second fluid flow opening when nested with another of said centrifugal cleaners.

2. A centrifugal cleaner as recited in claim 1 wherein each of said first fluid flow openings has a male tapered end face and each of said second fluid flow openings has a female tapered end face, said male tapered end face adapted to slide into and mate with said female tapered end face.

* * * * *